US008840572B2

(12) United States Patent
Whalen et al.

(10) Patent No.: US 8,840,572 B2
(45) Date of Patent: Sep. 23, 2014

(54) SYSTEM, METHOD AND APPARATUS FOR APPLYING AIR PRESSURE ON A PORTION OF THE BODY OF AN INDIVIDUAL

(75) Inventors: Sean Tremaine Whalen, Los Altos, CA (US); Silas Boyd-Wickizer, Cottage Grove, OR (US)

(73) Assignee: AlterG, Inc., Fremont, CA (US)

( * ) Notice: Subject to any disclaimer, the term of this patent is extended or adjusted under 35 U.S.C. 154(b) by 0 days.

(21) Appl. No.: 12/236,465

(22) Filed: Sep. 23, 2008

(65) Prior Publication Data

US 2009/0018571 A1 Jan. 15, 2009

Related U.S. Application Data

(63) Continuation of application No. 11/236,952, filed on Sep. 28, 2005, now Pat. No. 7,591,795.

(51) Int. Cl.

| | |
|---|---|
| ***A61H 7/00*** | (2006.01) |
| ***A61H 1/00*** | (2006.01) |
| ***A61G 10/02*** | (2006.01) |

(52) U.S. Cl.

CPC ..... *A61G 10/023* (2013.01); *A63B 2208/053* (2013.01)

USPC ..... 601/11; 601/6

(58) Field of Classification Search

USPC ..... 601/5–11, 23, 25; 128/202.12, 205.26; 482/54; 600/19

See application file for complete search history.

(56) References Cited

U.S. PATENT DOCUMENTS

| | | | | |
|---|---|---|---|---|
| 44,198 | A | 9/1864 | Jones | |
| 54,530 | A | 5/1866 | Hadfield | |
| 60,883 | A | 1/1867 | Hadfield | |
| 72,631 | A | 12/1868 | Hadfield | |
| 100,867 | A | 3/1870 | Curran | |
| 871,074 | A | 11/1907 | Stockton | |
| 3,768,467 | A | 10/1973 | Jennings | |
| 4,149,712 | A | 4/1979 | Murphy | |
| 4,257,407 | A | 3/1981 | Macchi | |
| 4,343,302 | A | 8/1982 | Dillon | |
| 4,411,422 | A | 10/1983 | Solloway | |
| 4,509,513 | A | 4/1985 | Lasley | |
| 4,536,163 | A | 8/1985 | Schnirch et al. | |
| 4,576,376 | A | 3/1986 | Miller | |
| 4,621,621 | A | 11/1986 | Marsalis | |
| 4,712,788 | A | 12/1987 | Gaudreau, Jr. | |
| 4,776,581 | A | 10/1988 | Shepherdson | |
| 4,805,601 | A | 2/1989 | Eischen, Sr. | |
| 4,934,694 | A * | 6/1990 | McIntosh | 482/9 |
| 4,959,047 | A | 9/1990 | Tripp, Jr. | |
| 4,974,829 | A | 12/1990 | Gamow et al. | |
| 5,029,579 | A | 7/1991 | Trammel | |
| 5,075,902 | A | 12/1991 | McReynolds et al. | |
| 5,133,339 | A | 7/1992 | Whalen et al. | |
| 5,242,339 | A | 9/1993 | Thornton | |
| 5,356,361 | A | 10/1994 | Watenpaugh | |
| 5,368,532 | A | 11/1994 | Farnet | |
| 5,398,678 | A | 3/1995 | Gamow | |
| 5,527,242 | A | 6/1996 | Gangloff | |
| 5,571,062 | A * | 11/1996 | Saganovsky | 482/54 |
| 5,702,323 | A | 12/1997 | Poulton | |
| 5,738,612 | A | 4/1998 | Tsuda | |
| 5,799,652 | A | 9/1998 | Kotliar | |
| 5,860,857 | A | 1/1999 | Wasastjerna et al. | |
| 5,921,892 | A | 7/1999 | Easton | |
| 6,027,464 | A | 2/2000 | Dahlquist | |
| 6,033,344 | A * | 3/2000 | Trulaske et al. | 482/7 |
| 6,042,537 | A * | 3/2000 | Kaiser | 600/38 |
| 6,332,354 | B1 * | 12/2001 | Lalor et al. | 73/121 |
| 6,482,128 | B1 | 11/2002 | Michalow | |
| 6,527,678 | B1 | 3/2003 | Wang et al. | |
| 6,539,946 | B2 | 4/2003 | Weyergans | |
| 6,565,624 | B2 | 5/2003 | Kutt et al. | |
| 6,666,831 | B1 | 12/2003 | Edgerton et al. | |
| D495,384 | S | 8/2004 | Rolfes | |
| 6,783,482 | B2 | 8/2004 | Oglesby et al. | |
| 6,905,459 | B2 | 6/2005 | Humphries, Jr. | |
| 7,141,007 | B2 * | 11/2006 | Egger | 482/57 |
| 7,189,193 | B2 | 3/2007 | Egger | |
| 7,556,040 | B2 * | 7/2009 | Meyer et al. | 128/205.26 |
| 7,591,795 | B2 | 9/2009 | Whalen et al. | |
| 7,837,597 | B2 | 11/2010 | Reyes et al. | |
| 7,850,629 | B2 | 12/2010 | Ravikumar | |
| 2003/0032904 | A1 | 2/2003 | Egger | |
| 2003/0204148 | A1 | 10/2003 | Lange et al. | |
| 2004/0238285 | A1 | 12/2004 | Stokes | |
| 2005/0075680 | A1 | 4/2005 | Lowry et al. | |
| 2006/0009333 | A1 | 1/2006 | Wang | |
| 2006/0185065 | A1 | 8/2006 | Allen | |
| 2006/0190051 | A1 | 8/2006 | Gerber et al. | |
| 2007/0054783 | A1 | 3/2007 | Egger | |
| 2009/0014004 | A1 | 1/2009 | Whalen et al. | |
| 2009/0082700 | A1 | 3/2009 | Whalen et al. | |
| 2011/0098157 | A1 | 4/2011 | Whalen et al. | |

(Continued)

FOREIGN PATENT DOCUMENTS

| | | |
|---|---|---|
| CN | 2034152 U | 3/1989 |
| CN | 2208414 Y | 9/1995 |

(Continued)

OTHER PUBLICATIONS

Anonymous. (Dec. 31, 2003). "Feedback Control System," *The Encyclopedia Americana International Edition 2003*, pp. 82-84.

(Continued)

*Primary Examiner* — Rachel Young

(74) *Attorney, Agent, or Firm* — Shay Glenn LLP

(57) ABSTRACT

A system is provided by applying pressure to a portion of a body of an individual in a chamber having an aperture along a vertical axis for receiving the portion of the body of the individual. A pressure sensor is coupled to the chamber for measuring a pressure inside the chamber. A negative feedback control system, calibrates, adjusts and maintains the pressure inside the chamber.

34 Claims, 6 Drawing Sheets

(56) References Cited

U.S. PATENT DOCUMENTS

| | | | |
|---|---|---|---|
| 2011/0098615 | A1 | 4/2011 | Whalen et al. |
| 2011/0120567 | A1 | 5/2011 | Kuehne et al. |
| 2012/0277643 | A1 | 11/2012 | Whalen et al. |
| 2013/0324893 | A1 | 12/2013 | Kuehne et al. |

FOREIGN PATENT DOCUMENTS

| | | | |
|---|---|---|---|
| JP | 59-002993 | | 1/1984 |
| JP | 63109878 | A | 5/1988 |
| JP | 5-500760 | | 2/1993 |
| JP | 05-049596 | A | 6/1993 |
| JP | 1022334 | | 10/1998 |
| JP | 2000-342713 | | 12/2000 |
| JP | 2001-112886 | | 4/2001 |
| JP | 2002-360644 | | 12/2002 |
| JP | 2008-538511 | A | 10/2008 |
| WO | WO 2006/050787 | A1 | 5/2006 |
| WO | WO 2006/061834 | A2 | 6/2006 |
| WO | WO-2007/038793 | A2 | 4/2007 |
| WO | WO-2007/038793 | A3 | 4/2007 |

OTHER PUBLICATIONS

International Search Report mailed on May 2, 2007, for PCT Application No. PCT/US06/38591, one page.

Notice of Allowance mailed on Aug. 7, 2009, for U.S. Appl. No. 11/236,952, filed Sep. 28, 2005, four pages.

Whalen et al.; Design U.S. Appl. No. 29/337,097 entitled "Adjustable Positive Pressure Support System," filed May 14, 2009.

Kuehne et al.; U.S. Appl. No. 13/423,124 entitled "Differential air pressure systems and methods of using and calibrating such systems for mobility impaired users," filed Mar. 16, 2012.

Hargens et al.; Lower body negative pressure to provide load bearing in space; Aviat Space Environ Med; 62(10); pp. 934-937; Oct. 1991.

Vacu Well Wellness & Beauty; Company History and Vacu Well Power Professional treadmill specifications; printed from website (http://www.vacuwell.com); 3 pgs.; printed Apr. 4, 2012.

* cited by examiner

SYSTEM, METHOD AND APPARATUS FOR APPLYING AIR PRESSURE ON A PORTION OF THE BODY OF AN INDIVIDUAL

CROSS REFERENCE TO RELATED APPLICATIONS

This application is a continuation of and claims priority from U.S. patent application Ser. No. 11/236,952 filed on Sep. 28, 2005 now U.S. Pat. No. 7,591,795.

FIELD OF THE INVENTION

The present invention relates to differential air pressure devices. More particularly, the present invention relates to a system, method and apparatus using air pressure.

BACKGROUND OF THE INVENTION

Gravity produces forces on the body. Methods of counteracting these forces have been devised for therapeutic as well as physical training uses. One way to counteract the effects of gravity on a body is to attach elastic cords at the waist and/or shoulder to produce either a positive or negative vertical force on the individual. The application of forces by the elastic cords on the body is uncomfortable and cumbersome to setup.

Furthermore, other systems using differential air pressure to simulate that effect are complicated and do not provide any intelligent feedback.

Therefore, a need exists for a comfortable integrated system for applying air pressure to a part of the body of an individual standing upright for control of bodyweight. The system should enable the individual to either feel heavier or lighter based on the exerted force from the system. A primary purpose of the present invention is to solve these needs and provide further, related advantages.

BRIEF DESCRIPTION OF THE INVENTION

A system is provided by applying pressure to a portion of a body of an individual in a chamber having an aperture along a vertical axis for receiving the portion of the body of the individual. A pressure sensor is coupled to the chamber for measuring a pressure inside the chamber. A negative feedback control system calibrates, adjusts and maintains the pressure inside the chamber.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

In the drawings.

DETAILED DESCRIPTION

Embodiments of the present invention are described herein in the context of a system, method and apparatus using air pressure. Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings. The same reference indicators will be used throughout the drawings and the following detailed description to refer to the same or like parts.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

In accordance with one embodiment of the present invention, the components, process steps, and/or data structures may be implemented using various types of operating systems (OS), computing platforms, firmware, computer programs, computer languages, and/or general-purpose machines. The method can be run as a programmed process running on processing circuitry. The processing circuitry can take the form of numerous combinations of processors and operating systems, or a stand-alone device. The process can be implemented as instructions executed by such hardware, hardware alone, or any combination thereof. The software may be stored on a program storage device readable by a machine.

In addition, those of ordinary skill in the art will recognize that devices of a less general purpose nature, such as hardwired devices, field programmable logic devices (FPLDs), including field programmable gate arrays (FPGAs) and complex programmable logic devices (CPLDs), application specific integrated circuits (ASICs), or the like, may also be used without departing from the scope and spirit of the inventive concepts disclosed herein.

Figure 1:
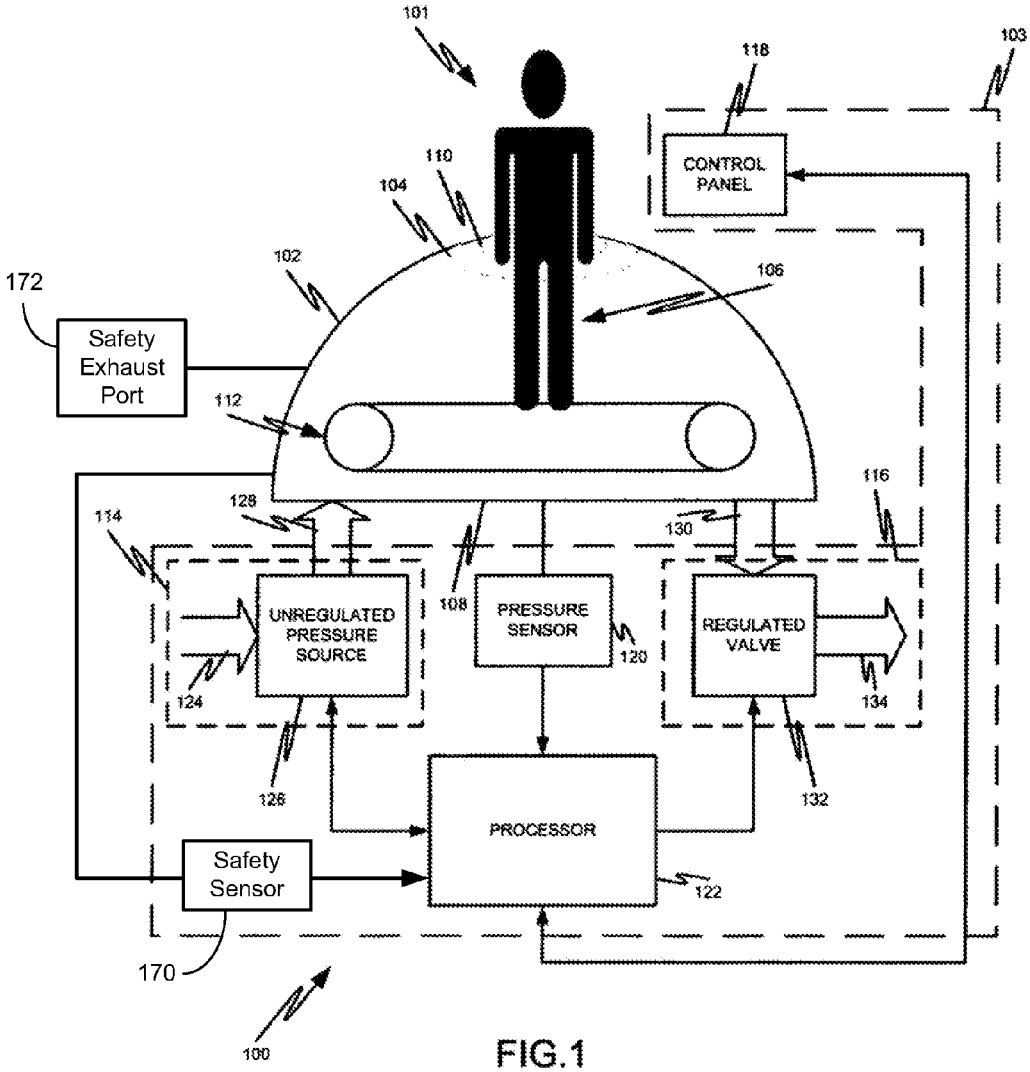
FIG. 1 is a block diagram schematically illustrating a system for exercise using air pressure in accordance with one embodiment.

FIG. 1 is a block diagram schematically illustrating a system 100 for applying pressure to a lower body 106 of an individual 101 in accordance with one embodiment. The system includes a chamber 102 and means 103 for adjusting (increasing or decreasing) and maintaining the pressure inside the chamber 102. An example of means 103 is a negative feedback control system described below.

The chamber 102 includes an aperture 104 along a vertical axis for receiving the lower body 106. In accordance with one embodiment, the chamber 102 may include a soft or rigid shell.

With respect to the chamber 102 having a soft shell, the soft shell may be inflated or deflated accordingly. The chamber 102 may take a semi-spherical shape when soft shell is inflated. FIG. 1 illustrates one embodiment where the chamber 102 includes a top portion of a sphere with a planar cross-section as a base 108 of the chamber 102. The base 108 supports the individual 101 standing upright or sitting upright. The soft shell may be made of a sufficiently airtight fabric. While deflated, the soft shell may allow for the lower body 106 to be positioned within the aperture 104. The aperture 104 may include an elliptical shape and flexible fabric for accommodating various shapes of waistline of the individual lower body 106. The height of the fabric soft shell may be altered by using straps to pull down on the top part. For example, the aperture 104 may include a rigid ring (not shown) that surrounds the waist or torso of the individual 101. The height of the chamber 102 can thus be adjusted by raising or lowering the rigid ring.

A bar (not shown) may encompass the fabric shell below the waist of the individual 101. The bar holds the fabric shell in from expanding into a spherical shape, therefore keeping the shell close to the torso of the individual 101 allowing for comfortable arm swing. Similarly, the rigid shell may allow for keeping the arms of the individual 101 from touching the rigid shell while the individual 101 is moving (walking or running) through a saddle shape.

The system 100 may also include a rear entrance walkway (not shown) having a step to facilitate entrance and exit to and from the chamber 102. In the chamber 102 having a soft shell, the walkway may be used a means for holding the soft shell up in an uninflated state so that it is easier to attach the seal 110 to the individual 101. The walkway may also serve as a safety platform where in case the shell of the chamber 102 rips (in the case of fabric) or breaks (in the case of hard shell). The walkway may also include holding bars for the individual 101 to hold onto in the event of a fall.

With respect to the chamber 102 having a hard shell, the chamber 102 may include a door (not shown) that opens for the individual 101 to get in and out. The door can swing open, swing down, or slide open. The door can be comprised of fabric on a zipper that is zipped sufficiently air-tight. Aperture 104 may be created by moving two halves of chamber 102 apart and back together like clam-shell, or a cockpit. Additionally, the height of hard shell may be adjusted based on the height of individual 101.

A seal 110 is provided between the lower body 106 and the aperture 104 at or near the torso or the waistline of the individual 101. In accordance with one embodiment, the seal 110 includes a plurality of openings/leaks around the torso of the individual 101 to cool the individual 101 and to better control distribution of pressure around the torso of the individual 101. For example, leaks positioned in front by the stomach of the individual 101 help with the bloating due to ballooning of the flexible waist seal under pressure. Such deliberate leaks may be implemented by sewing non-airtight fabrics, or by forming holes in the shell or fabric of the chamber 102. The seal 110 can be made of a substantially airtight material and/or non-airtight fabric. The seal 110 can be implemented with a skirt, pants, or a combination of both.

In accordance with one embodiment, the seal 110 may include separable seals by means of zippers, kayak style attachment over a rigid lip that is attached to the shell, clamps, and deformable loops. The seal 110 may include means for anchoring to the individual lower body 106 and means for attaching to the aperture 104. Means for anchoring may include, for example, Velcro straps that run around the thighs for adjustment of different thigh widths, a belt that keeps the seal anchored at the hipbone. Means for anchoring may also include a high friction material that seals against the user and remains anchored because of a high friction coefficient. The seal 110 may be breathable and washable. In accordance with another embodiment, the seal 110 may also seal up to the individual chest. For example, the seal 110 may include a skirt-type seal.

An exercise machine 112 may be housed within the chamber 102. The exercise machine 112 may be, for example, a treadmill having an adjustable height, inclination, and speed. The height and position of the exercise machine 112 can be adjusted based on a dimension of the individual 101. Those of ordinary skill in the art will appreciate that the treadmill shown is not intended to be limiting and that other exercise machines can be used without departing from the inventive concepts herein disclosed. The chamber 102 may be used without any machines as a means to improve jumping ability or general movement.

Means 103 for adjusting and maintaining the pressure inside the chamber includes an intake system 14, an outtake system 116, a control panel 118, a pressure sensor 120, and a processor 122.

Intake system 114 includes an input port 124 for receiving a gas (for example, air), a pressure source 126 (pump), and an output port 128. The gas flow from pressure source 126 may be unregulated. Pressure source 126 can either be turned on or off. In accordance with another embodiment, the pressure source 126 may include a variable fan speed that can be adjusted for controlling the incoming airflow to the chamber 102. Pressure source 126 pumps gas from input port 124 to output port 128. Output port 128 is also an input port of chamber 102. Gas is pumped into chamber 102 via output port 128.

Outtake system 116 includes an input port 130 for receiving gas from chamber 102, a pressure regulating valve 132, and an output port 134 to ambient pressure. The pressure regulating valve 132 controls the exhaust flow from the chamber 102. The input port 130 is an output port of the chamber 102. Gas leaves the chamber 102 via the output port 134. In accordance with another embodiment, a safety exhaust port 172 may be connected to the chamber 102 for allowing gas to exit the chamber 102 in case of an emergency or a system failure.

The control panel 118 includes a user interface system for allowing the individual 101 or an operator to interact with the system 100 via the processor 122. For example, the individual 101 may use a touch-screen interface (not shown) on the control panel 118 to program the pressure within the chamber 102, and the speed, the inclination, and the height of the exercise machine 112. The control panel 118 may also be used to calibrate the individual 101 for correct bodyweight. The calibration process is described in further detail in FIG. 6.

The pressure sensor 120 is connected to the chamber 102 for measuring a differential pressure between the pressure inside the chamber 102 and the ambient pressure. Those of ordinary skill in the art will appreciate that the pressure sensor 102 shown is not intended to be limiting and that other types of pressure transducer or pressure measuring sensors can be used without departing from the inventive concepts herein disclosed. The pressure sensor 120 communicates its measurements to the processor 122.

Figure 3:
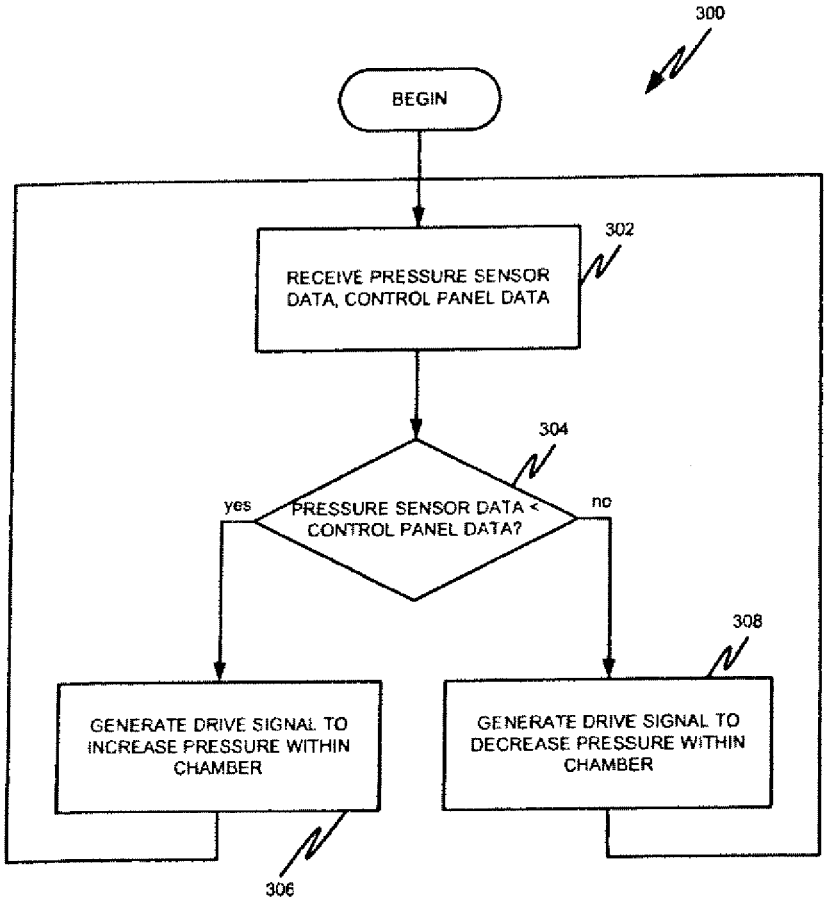
FIG. 3 is a flow diagram schematically illustrating a method for operating the system of FIGS. 1 and 2 in accordance with one embodiment.
Figure 4:
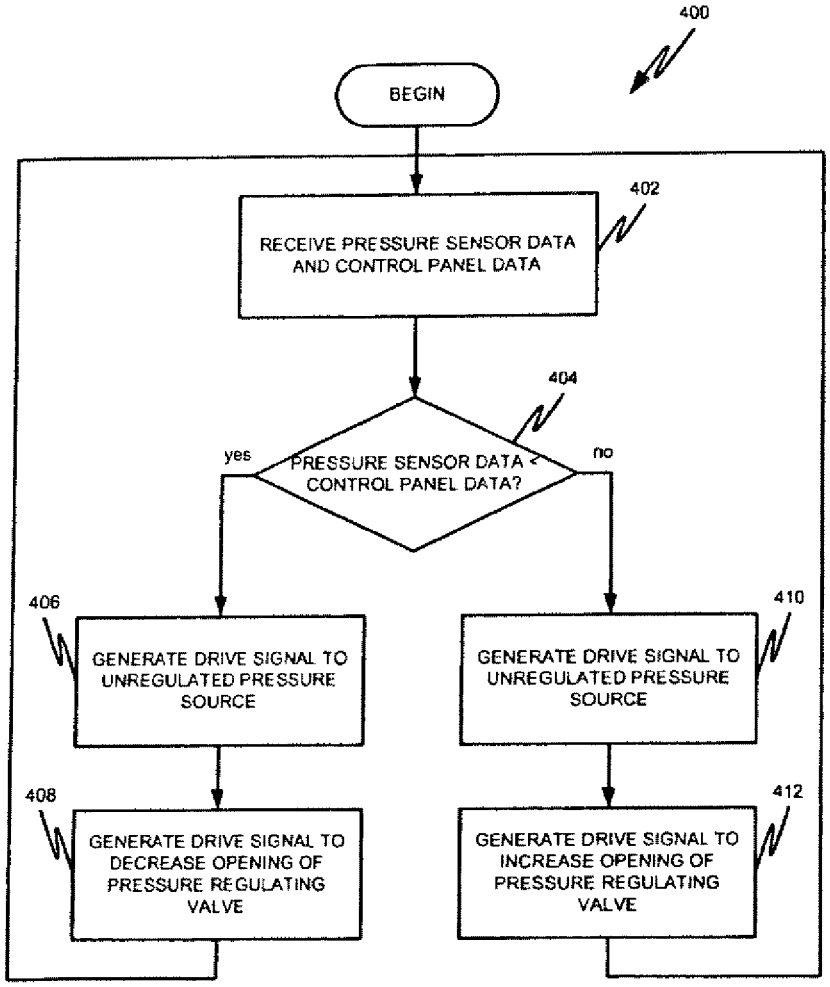
FIG. 4 is a flow diagram schematically illustrating a method for operating the system of FIG. 1 in accordance with one embodiment.

The processor 122 communicates with the control panel 118 and the pressure sensor 120 to control the pressure source 126 and the pressure regulating valve 132. An example of the algorithm of the processor 122 is illustrated in FIGS. 3 and 4. In this configuration, the processor 122 receives an input from the control panel 118. For example, the input may include a desired pressure within the chamber 102 or a desired body weight of the individual. The processor 122 operates the pressure source 126 and the regulated valve 132 using a negative feedback loop, circuit, or system as illustrated in FIGS. 3 and 4. The processor 122 monitors the pressure inside the chamber 102 with the pressure sensor 120. Based on the measurements from the pressure sensor 120 and the input from the control panel 118, the processor 122 sends a drive signal to the regulated valve 132 and/or the pressure source 126 to increase or decrease the exhaust flow through the chamber 102 so as to maintain the pressure within chamber 102 as close as possible to the desired pressure received from the control panel 118. The pressure (positive or negative) inside the chamber 102 produces an upward or downward force on the individual 101 resulting in a lighter or heavier sensation.

The processor 122 may also communicate with the exercise machine 112. The processor 122 may receive input parameters from control panel 118 for the exercise machine 112. For example, the exercise machine 112 may include a treadmill with speed or inclination adjusted by the processor 122 based on the pressure sensed inside the chamber 102.

In accordance with another embodiment, the system 100 may also be controlled to maintain various performance parameters such as constant stride frequency. A sensor may be placed on the treadmill to detect the impact from the users feet on the treadmill and compare with subsequent values to measure the time duration between strides. The machine can then adjust pressure, tilt, speed, etc. to maintain a specific stride rate.

In accordance with yet another embodiment, the system 100 may include a acceleration/deceleration sensor coupled to the individual 101 sensing whether the user is speeding up or slowing down. Those of ordinary skill in the art will recognize that there are many ways of implementing such a sensor. The processor 122 receives the measurement from the acceleration/deceleration sensor and may send a signal to the increase or decrease the speed of the treadmill in response to the measurement in combination with increasing or decreasing the pressure inside the chamber 102.

The processor 122 may also include a data storage (not shown) such as a database storing various executable programs that may be selected or programmed in by the individual 101 or an operator via the control panel 118. The data storage may include a repository of data that may be used to control the system 100. For example, while receiving data from sensors (including the pressure sensor, performance sensors of the individual, a safety sensor 170, etc. . . . ) the processor 122 may determine that one or more parameters has reached a dangerous level. The processor 122 then alters the pressure and/or the speed of the treadmill 112. For example, a trainer could set a maximum speed parameter for the individual 101. The processor 122 would ensure that that speed is not to be exceeded. The data storage may also be used to store past performances and personal records for different protocols and the system 100 could allow the individual 101 to run against previous personal records.

The data storage may also include various training programs based on the selection from the control panel 118. The processor 122 would then ensure non-harmful activity levels of the individual 101 based on all variables. The data storage may also be able to log and record the performance and activities of the individual 101 as well as store any calibration data so that the individual 101 does not have to go through that the calibration process every time they use the machine.

Figure 2:
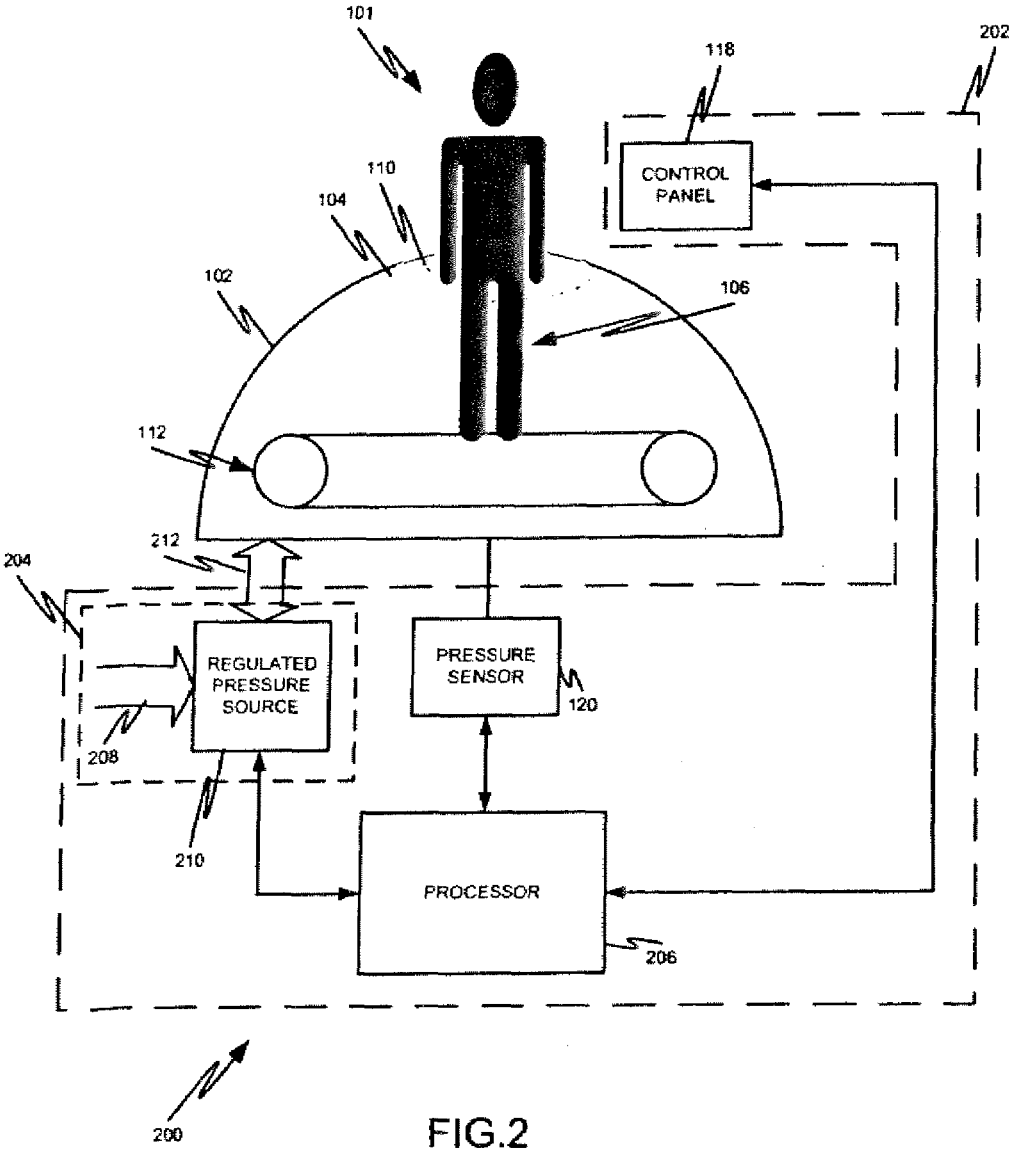
FIG. 2 is a block diagram schematically illustrating a system for exercise using air pressure in accordance with another embodiment.

FIG. 2 is a block diagram schematically illustrating a system 200 for applying pressure to a lower body 106 the individual 101 in accordance with another embodiment. The system 200 includes the chamber 102 and means 202 for adjusting (raising or decreasing) and maintaining the pressure inside the chamber 102. An example of means 202 is a negative feedback control system described below.

Means 202 for adjusting and maintaining the pressure inside the chamber 102 includes an intake system 204, the control panel 118, the pressure sensor 120, and a processor 206.

The intake system 204 includes an input port 208 for receiving a gas (for example, air), a regulated pressure source 210, and an output port 212. The regulated pressure source 210 pumps gas from the input port 208 to the output port 212. The output port 212 is also an input port into the chamber 102. Gas is pumped in and out of the chamber 102 via the output port 212. The inflow of air is regulated via the regulated pressure source 210. The regulated pressure source 210 includes an adjustable valve for controlling the gas flow rate through output port 212. In accordance with another embodiment, the regulated pressure source may include a pump having an adjust fan blade size or fan speed. The gas flow rate can be adjusted by varying the fan speed or fan blade size. A safety exhaust port (not shown) may be connected to the chamber 102 for allowing gas to exit the chamber 102 in case of an emergency or a system failure.

Figure 5:
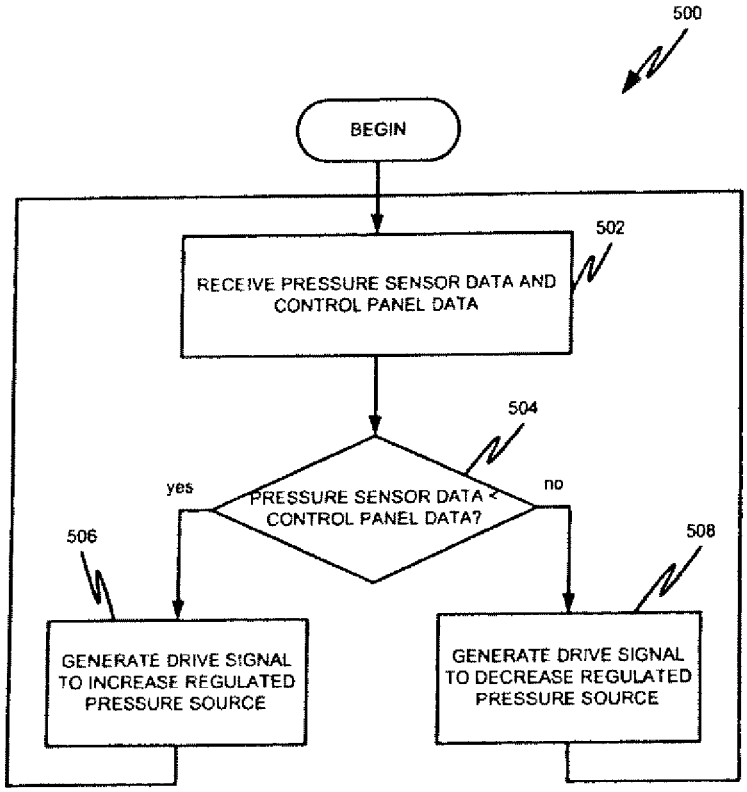
FIG. 5 is a flow diagram schematically illustrating a method for operating the system of FIG. 2 in accordance with one embodiment.

The processor 206 communicates with the control panel 118 and the pressure sensor 120 to control the regulated pressure source 210. An example of the algorithm of processor 122 is illustrated in FIGS. 3 and 5. In this configuration, the processor 206 receives an input from the control panel 118. For example, the input may include a desired pressure inside the chamber 102 or a body weight of the individual. The processor 206 operates the regulated pressure source 210 using a negative feedback loop, circuit, or system as illustrated in FIGS. 3 and 5. The processor 206 monitors the pressure inside the chamber 102 with the pressure sensor 120. Based on the measurements from the pressure sensor 120 and the input from the control panel 118, the processor 122 sends a drive signal to the regulated pressure source 210 to increase or decrease the gas flow through the chamber 102 so as to maintain the pressure within chamber 102 as close as possible to the desired pressure received from the control panel 118. The pressure (positive or negative) inside the chamber 102 produces an upward or downward force on the individual 101 resulting in a lighter or heavier sensation.

The processor 206 may also communicate with an exercise machine 112 housed inside the chamber 102. The processor 206 may receive input parameters from the control panel 118 for the exercise machine 112. For example, the exercise machine 112 may include a treadmill with speed or inclination adjusted by the processor 206 based on the pressure sensed inside the chamber 102.

The processor 206 may also include a data storage (not shown) such as a database storing various executable programs that may be selected or programmed in by the individual 101 or an operator via the control panel 118. The data storage may include a repository of data that may be used to control the system 200. For example, while receiving data from all sensors, the processor 206 may determine that one or more parameters have reached a dangerous level. The processor 206 then alters the pressure and/or the speed of the treadmill 112. For example, a trainer could set a maximum speed parameter for the individual 101. The processor 206 would ensure that that speed is not to be exceeded. The data storage may also be used to store past performances and personal records for different protocols and the system 200 could allow the individual 101 to run against previous personal records.

The data storage may also include various training programs based on the selection from the control panel 118. The processor 206 would then ensure non-harmful activity level of individual 101 based on all the variables. The data storage may also be able to log and record the performance and activities of individual 101.

FIG. 3 is a flow diagram 300 schematically illustrating a method for operating the system of FIGS. 1 and 2 in accordance with one embodiment. The flow diagram 300 features a negative feedback loop, circuit, or system constantly monitoring the pressure inside the chamber 102 and adjusting the pressure inside the chamber 102 based on the monitoring. The negative feedback loop may operate at a high frequency so as to accurately control and stabilize the pressure inside the chamber 102. At 302, the processor receives user data (for example, a desired pressure) from control panel 118 and sensor data from pressure sensor 120 (and optionally other sensors—performance sensors measuring the performance of the individual—stride frequency and acceleration/deceleration of the individual, etc. . . . ). At 304, the processor compares sensor data with the user data to determine whether to increase or decrease the pressure inside the chamber 102. In accordance with another embodiment, the processor may also compare the user data, the sensor data with various programs stored in a database. At 306, the processor generates a control signal to increase the pressure inside the chamber 102 if the pressure sensor data is less than the user data. At 308, the processor generates a control signal to decrease the pressure inside the chamber 102 if the pressure sensor data is greater than the user data. The process loops back to 302 where a new measurement is received. For example, the system cycles through this negative feedback loops 100 times a second.

FIG. 4 is a flow diagram 400 schematically illustrating a method for operating the system of FIG. 1 in accordance with one embodiment. The flow diagram 400 features a negative feedback loop, circuit, or system constantly monitoring the pressure inside the chamber 102 and adjusting the pressure inside the chamber 102 based on the monitoring. The negative feedback loop may operate at a high frequency so as to accurately control and stabilize the pressure inside the chamber 102. At 402, the processor 122 receives a user data from the control panel 118 and a sensor data from the pressure sensor 120 (and optionally other sensors). At 404, the processor 122 compares the sensor data with the user data to determine whether to increase on decrease the pressure inside the chamber 102. In accordance with another embodiment, the processor 122 may also compare the user data, the sensor data with various programs stored in a database. If the sensor data is less than the user data, the processor 122 generates a drive signal to control the unregulated pressure source 126 at 406, and a drive signal to decrease the opening of the pressure regulating valve 132 at 408. If the sensor data is greater than the user data, the processor 122 generates a drive signal to control the unregulated pressure source 126 at 410, and a drive signal to increase the opening of the pressure regulating valve 132 at 412. The process loops back to 402 where a new measurement is received. For example, the system cycles through this negative feedback loops about 100 times a second.

FIG. 5 is a flow diagram schematically illustrating a method for operating the system of FIG. 2 in accordance with another embodiment. The flow diagram 500 features a negative feedback loop constantly monitoring the pressure inside the chamber 102 and adjusting the pressure inside the chamber 102 based on the monitoring. The negative feedback loop may operate at a high frequency so as to accurately control and stabilize the pressure inside the chamber. At 502, the processor 206 receives a user data from the control panel 118 and a sensor data from the pressure sensor 120 (and optionally other sensors). At 504, the processor 206 compares the sensor data with the user data to determine whether to increase on decrease the pressure inside the chamber 102. In accordance with another embodiment, the processor 206 may also compare user data, sensor data with various programs stored in a database. At 506, the processor 206 generates a drive signal to increase the regulated pressure source 210 by increasing the gas intake flow into chamber 102 if the sensor data is less than the user data. At 508, the processor 206 generates a drive signal to decrease the regulated pressure source 210 by decreasing the gas intake flow into chamber 102 if the sensor data is greater than the user data.

Figure 6:
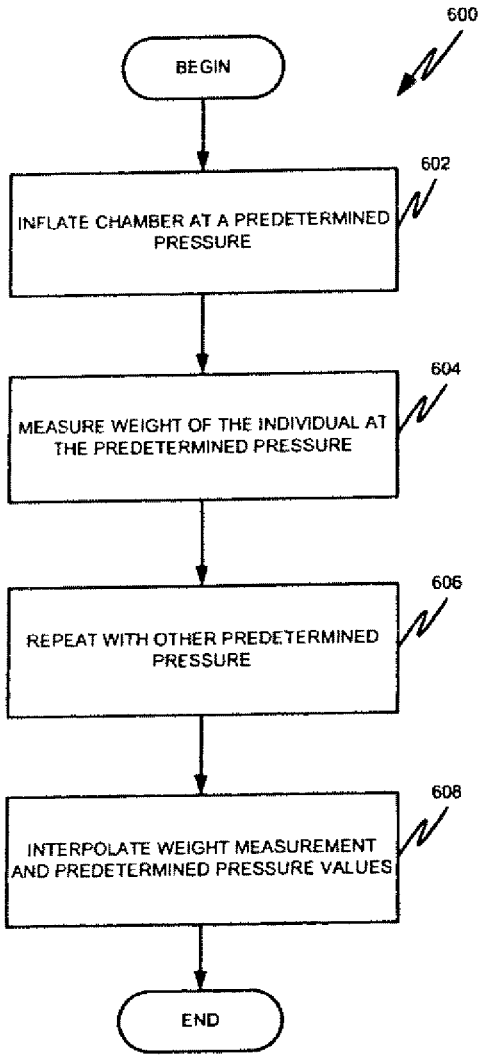
FIG. 6 is a flow diagram schematically illustrating a method for calibrating the system of FIG. 1 and FIG. 2 in accordance with one embodiment.

FIG. 6 is a flow diagram 600 schematically illustrating a method for calibrating the system of FIG. 1 and FIG. 2 in accordance with one embodiment. At 602, the chamber 102 is inflated to a predetermined pressure. At 604, the weight of the individual 101 is measured for example, by using a conventional scale. The measured weight may be directly communicated from the scale to the processor 122/206 or manually by entering it on the control panel 118. The process may be optionally repeated for several other predetermined pressures at 606. A relationship between the pressure and actual weight of the individual 101 is generated by interpolating the measurement values and the predetermined pressure at 608 across the full operating pressure range of the machine. Multiple measured points may be desirable because of the non-linearity of the system at lower bodyweights.

While embodiments and applications of this invention have been shown and described, it would be apparent to those skilled in the art having the benefit of this disclosure that many more modifications than mentioned above are possible without departing from the inventive concepts herein. For example, the present invention may be applicable to containing any part of the body, such as the upper body, torso area, etc. . . . The invention, therefore, is not to be restricted except in the spirit of the appended claims.

What is claimed is:

1. An exercise apparatus comprising:

a pressurizable chamber configured to receive a portion of a body of an individual and to apply positive pressure to the body portion during exercise;

a treadmill inside the pressurizable chamber;

a pressure source that can either be turned on or off and is unregulated during use to apply positive pressure to the body portion during exercise;

a regulated exhaust valve;

a pressure sensor connected to the pressurizable chamber for measuring the pressure within the pressurizable chamber and electronically communicating the measured pressure to a processor, the processor is configured to receive an input of the individual's weight at at least two different positive pressure values, generate a measured weight and positive pressure relationship for the individual, and to control the regulated exhaust valve to regulate the positive pressure in the chamber by referring to only the generated relationship and measured pressure electronically communicated from the pressure sensor without continuously measuring the individual's weight, the processor further configured to control a speed of the treadmill by comparing the measured pressure inside the chamber to a stored safety parameter.

2. The exercise apparatus of claim 1, wherein the chamber comprises a safety exhaust port for allowing gas to exit the chamber in case of an emergency or a system failure.

3. The exercise apparatus of claim 2, wherein the processor is configured to actuate the safety exhaust port based upon the comparison.

4. The exercise apparatus of claim 1, wherein the processor is configured to regulate positive pressure in the chamber by monitoring the measured pressure and altering positive pressure in the chamber according to the generated relationship.

5. The exercise apparatus of claim 1, wherein the processor is configured to use negative feedback control to regulate pressure in the chamber.

6. The exercise apparatus of claim 1, wherein the chamber is customizable to accommodate individuals of varying height and/or waist size.

7. The exercise apparatus of claim 1, wherein the processor is configured to interpolate the measured weight and positive pressure values to generate a measured weight and positive pressure relationship.

8. The exercise apparatus of claim 1, wherein the processor generates the relationship across a full operating pressure range of the treadmill.

9. The exercise apparatus of claim 1, wherein the processor stores a limit value for the safety parameter.

10. The exercise apparatus of claim 9, wherein the processor is configured to change the speed of the treadmill when the processor receives a measured pressure from the pressure sensor that is greater than the stored limit value.

11. The exercise apparatus of claim 9, wherein the processor decreases the positive pressure in the chamber as a result of the comparison of the measured pressure and the stored limit value.

12. The exercise apparatus of claim 1, wherein the processor is configured to store data corresponding to maximum safety levels for the safety parameter.

13. The exercise apparatus of claim 12, wherein the processor is configured to receive data from the pressure sensor and compare the received data with the maximum safety levels.

14. The exercise apparatus of claim 12, wherein the processor is configured to decrease the speed of the treadmill when the maximum safety levels have been exceeded.

15. The exercise apparatus of claim 1, wherein the pressurizable chamber further comprises a soft shell enclosing the portion of the individual inside the chamber.

16. The exercise apparatus of claim 15, wherein the soft shell is semi-spherical when inflated.

17. The exercise apparatus of claim 15, wherein the soft shell comprises a base with a planar section.

18. The exercise apparatus of claim 15, wherein the soft shell comprises a substantially air tight fabric.

19. The exercise apparatus of claim 1, wherein the processor comprises a data storage configured to receive and store data from the pressure sensor.

20. The exercise apparatus of claim 1, wherein the processor is configured to receive the input of the individual's weight manually.

21. The exercise apparatus of claim 1, wherein the processor is configured to receive the input of the individual's weight automatically.

22. The exercise apparatus of claim 1, wherein the safety parameter is a maximum pressure.

23. The exercise apparatus of claim 1, wherein the safety parameter is a minimum pressure.

24. A method for conditioning an individual comprising:

electronically receiving an output signal from a weight sensor in electronic communication with a differential pressure system;

electronically receiving an output signal from a pressure sensor in electronic communication with the differential pressure system;

using the output from the weight sensor to generate a measured weight and positive pressure relationship for the individual from a measured weight and at at least two different positive pressure values;

regulating the positive pressure in the differential pressure system by referring to only the generated relationship and the electronically received output signal from the pressure sensor without continuously measuring the individual's weight; and reducing force on a portion of a body of the individual during exercise by enclosing the body portion in a positively pressurized chamber of the differential pressure system, comparing a pressure inside the chamber to a safety parameter of the differential pressure system; and shutting down a treadmill within the system based upon the comparison.

25. The method of claim 24, further comprising actuating a safety exhaust port to automatically release gas in case of an emergency.

26. The method of claim 24, comprising storing a limit from the pressure sensor in a data storage, comparing a measurement of the safety sensor with the stored limit, and adjusting pressure in the chamber using the comparison.

27. The method of claim 24, further comprising regulating positive pressure in the chamber by monitoring measured pressure and altering positive pressure in the chamber according to the generated relationship.

28. The method of claim 24, further comprising regulating pressure in the chamber using negative feedback control.

29. The method of claim 24, wherein an output of a safety sensor relates to a speed of a moving platform in the treadmill.

30. The method of claim 24 further comprising storing data corresponding to maximum safety levels.

31. The method of claim 30, further comprising electronically receiving an output signal from a safety sensor in electronic communication with the differential pressure system.

32. The method of claim 31, further comprising comparing the received output from the safety sensor with the maximum safety levels and determining whether one or more of the maximum safety levels has been exceeded.

33. The method of claim 32 further comprising decreasing the positive pressure inside the pressurized chamber when one or more of the maximum safety levels have been exceeded.

34. The method of claim 24, wherein a safety sensor is connected to measure the safety parameter of the pressurizable chamber.

* * * * *